US007861528B2

(12) United States Patent
Myers et al.

(10) Patent No.: US 7,861,528 B2
(45) Date of Patent: Jan. 4, 2011

(54) FUEL NOZZLE AND DIFFUSION TIP THEREFOR

(75) Inventors: Geoffrey D. Myers, Simpsonville, SC (US); Scott Simmons, Greenville, SC (US); Stephen R. Thomas, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 747 days.

(21) Appl. No.: 11/892,298

(22) Filed: Aug. 21, 2007

(65) Prior Publication Data

US 2009/0050710 A1 Feb. 26, 2009

(51) Int. Cl.
*F02C 1/00* (2006.01)

(52) U.S. Cl. ..... 60/737; 60/740

(58) Field of Classification Search ..... 60/737, 60/740, 742, 748, 738, 746
See application file for complete search history.

(56) References Cited

U.S. PATENT DOCUMENTS 4,229,944 A * 10/1980 Weiler ..... 60/740
4,373,325 A * 2/1983 Shekleton ..... 60/776
4,914,918 A * 4/1990 Sullivan ..... 60/756
5,121,608 A * 6/1992 Willis et al. ..... 60/737
5,351,489 A * 10/1994 Okamoto et al. ..... 60/740
5,444,982 A * 8/1995 Heberling et al. ..... 60/737
5,671,597 A * 9/1997 Butler et al. ..... 60/796
6,311,471 B1 * 11/2001 Waldherr et al. ..... 60/775
6,363,724 B1 * 4/2002 Bechtel et al. ..... 60/737
6,438,961 B2 8/2002 Tuthill et al.
7,007,477 B2 3/2006 Widener
7,694,521 B2 * 4/2010 Ohta et al. ..... 60/748
2006/0191268 A1 * 8/2006 Widener et al. ..... 60/772

* cited by examiner

*Primary Examiner*—Michael Cuff
*Assistant Examiner*—Gerald L Sung
(74) *Attorney, Agent, or Firm*—Nixon & Vanderhye PC

(57) ABSTRACT

A fuel nozzle having a dedicated circuit to cool the diffusion tip with lower part count and reduced complexity. More specifically, the proposed design uses an independent circuit to cool the tip with diffusion fuel or purge air. An impingement plate may be provided to augment the cooling effect.

19 Claims, 2 Drawing Sheets

FUEL NOZZLE AND DIFFUSION TIP THEREFOR

BACKGROUND OF THE INVENTION

The invention relates to a diffusion tip for a fuel nozzle for use in gas turbines. More particularly, the invention relates to a diffusion tip configuration and adaptations for cooling the same.

In a gas turbine, fuel nozzles are used to mix air and fuel for later combustion downstream. A diffusion mode is used for stable combustion during start up until premixed mode can be used to reduce NOx emissions. The diffusion tip of the nozzle must provide a mechanism for generating the diffusion flame during start up and remain cool enough to resist damage from hot combustion gases during premixed mode. Current designs use air diverted from the main path to cool the diffusion tip resulting in an uncertain air proportion of cooling versus main flow and a complicated flow path.

More specifically, a conventional diffusion tip 10 is illustrated in FIG. 1. As illustrated therein, the current design splits curtain air 12 into burner tube cooling air 14, diffusion air 16 and shower head air 18. As understood from the phantom line passage depiction at 20, the diffusion purge does not flow to the shower head portion 22. The flow split and therefore effective cooling in the three circuits 14, 16, 18 can vary based on input conditions and the cooling of the tip (from shower head air effusion cooling) cannot be independently modified. As illustrated, the configuration of FIG. 1 uses a plurality of holes 24 to accomplish the effusion cooling in the diffusion tip. For instances of high thermal and/or structural loading, these holes can act as stress intensification sites, reducing life to crack initiation. In addition, these holes may allow combustion gas entry into the diffusion cooling circuit if the pressure of the combustion gas is locally higher than the pressure in the diffusion cooling circuit.

BRIEF DESCRIPTION OF THE INVENTION

The invention proposes to use a dedicated circuit to cool the diffusion tip with lower part count and reduced complexity. More specifically, the proposed design uses an independent circuit to cool the tip with diffusion fuel or purge air. An impingement plate may be provided to augment the cooling effect. Thus, the invention may be embodied in a fuel nozzle, comprising: a burner tube component; a center body assembly concentrically disposed within said burner tube component; a premix flow passage defined between said burner tube component and said nozzle center body; a diffusion tip, said diffusion tip comprising a peripheral wall mounted to said center body assembly, a substantially imperforate end wall at a distal axial end of said peripheral wall, at least one orifice defined in said peripheral wall adjacent said axial end wall, and a diffusion tip shroud disposed in surrounding relation to said peripheral wall and mounted to said center body so as to define a cooling air flow passage therebetween, said at least one orifice being in flow communication with at least one of said cooling air flow passage and a recirculation zone downstream of said diffusion tip; and a diffusion fuel passage defined within said center body assembly and terminating distally at an inner surface of said substantially imperforate end wall.

The invention may also be embodied in a diffusion tip for a fuel nozzle, comprising: a peripheral wall, a substantially imperforate end wall at a distal axial end of said peripheral wall, at least one orifice defined in said peripheral wall adjacent said axial end wall, and a diffusion tip shroud disposed in surrounding relation to said peripheral wall so as to define a cooling air flow passage therebetween, said at least one orifice being in flow communication with at least one of said cooling air flow passage and a recirculation zone downstream of said diffusion tip.

BRIEF DESCRIPTION OF THE DRAWINGS

These and other objects and advantages of this invention, will be more completely understood and appreciated by careful study of the following more detailed description of the presently preferred example embodiments of the invention taken in conjunction with the accompanying drawings, in which.

DETAILED DESCRIPTION OF THE INVENTION

The present invention provides an assembly of machined and cast parts that allow injection of fuel into the gas turbine during diffusion operation. During premix operation, the unique arrangement of features of the inventive diffusion tip allows it to be effectively cooled and thus maintain a high level of reliability.

Figure 2:
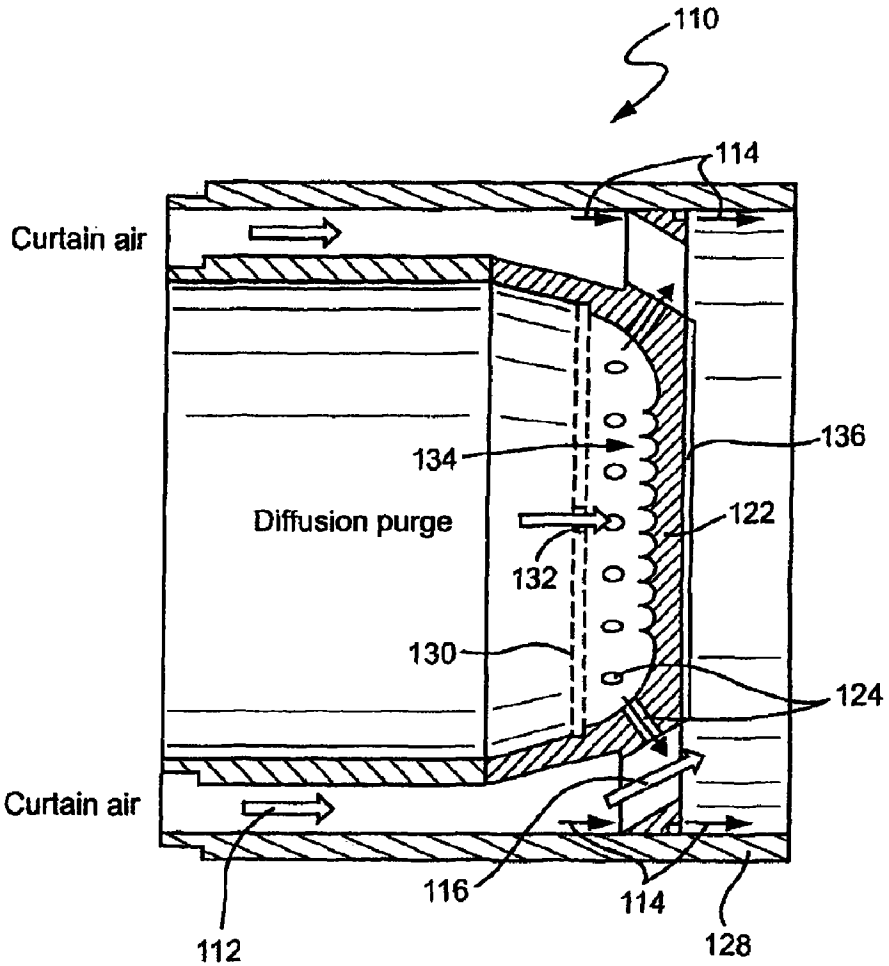
FIG. 2 is a schematic cross-sectional view of a diffusion tip embodying the invention.
Figure 1:
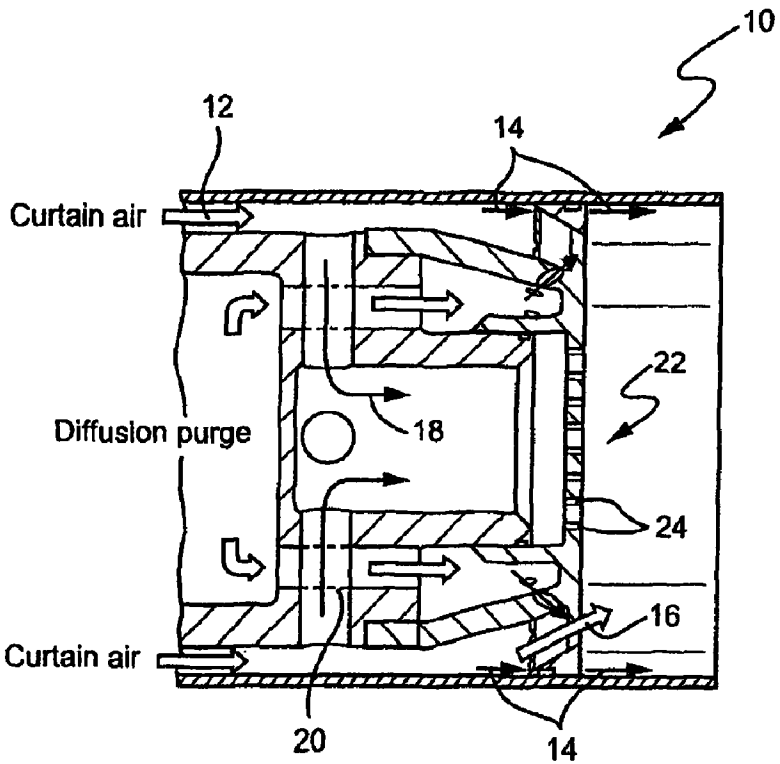
Fig. 1 PRIOR ART
FIG. 1 is a schematic cross-sectional view of a conventional diffusion tip.

Referring to FIG. 2, as compared to FIG. 1, the plurality of holes conventionally provided to accomplish effusion cooling of the diffusion tip are omitted according to the invention so that the proposed design does not have such holes as a source of stress intensification, and backflow is substantially precluded. Instead, the central portion 122 of the diffusion tip 110 is imperforate and orifices 124 are provided to flow diffusion purge air or diffusion fuel, according to nozzle operation, to join the curtain air flowing initially at 112 within the diffusion tip shroud 128 and at 116 at the diffusion tip. It should be noted that the orifices 124 are essentially the same as the orifices provided in the structure of FIG. 1 for the diffusion purge to join the curtain air at 16.

In the illustrated example embodiment, an impingement plate 130 is mounted in spaced parallel relation to the imperforate central portion 122 of the end wall of the diffusion tip 110. The impingement plate 130 comprises one or more impingement orifices 132 for impingement flow of e.g., diffusion purge air toward and against the inner surface of the central portion 122.

As also illustrated in FIG. 2, this example embodiment has a cooling enhancement feature in the impingement-cooled diffusion tip. More specifically, a rippled, wave-like back side surface is provided as illustrated at 134. This feature enhances cooling by increasing the surface area of the back side surface and/or turbulates the post-impingement coolant flow. Rather than the rippled wave-like back side illustrated, cooling may be enhanced by ribs, fins, pins or the like. As noted above, a plurality of orifices 124 are defined peripherally of the impingement cooled inner surface for diffusion purge to join the curtain air flowing concentrically thereto.

In an example embodiment, a layer of thermal barrier coating 136 is also added to the front face of the diffusion tip as schematically illustrated in FIG. 2. A class B TBC coating protects the tip from temperature gradients and increases back side cooling effectiveness.

The conventional design illustrated in FIG. 1 consists of three parts machined from Hast-X bar stock, then brazed together. The invention illustrated, e.g., in FIG. 2 uses only one part machined from Hast-X bar stock and uses a single full penetration weld instead of multiple brazes. In this way, a diffusion tip assembly embodying the invention reduces parts and braze joints, and allows swirl holes to have fillets.

As will be understood, the simplified diffusion tip design and flow paths provided according to the invention as illustrated in the example embodiment of FIG. 2 gives the same flow geometry as the current diffusion tip design for diffusion operation. However, rather than devoting a portion of the curtain air to flow through a perforated diffusion tip end face as in the FIG. 1 design, the tip end face is impingement cooled on the backside with diffusion purge air during premix and all curtain air 112 is flowed for diffusion 116 and burner tube cooling 114. The diffusion tip design also uses diffusion fuel to back side cool the diffusion tip so that diffusion mode and piloted premix metal average temperature is very cool, e.g., only 100° F. hotter than diffusion fuel temperature.

Figure 3:
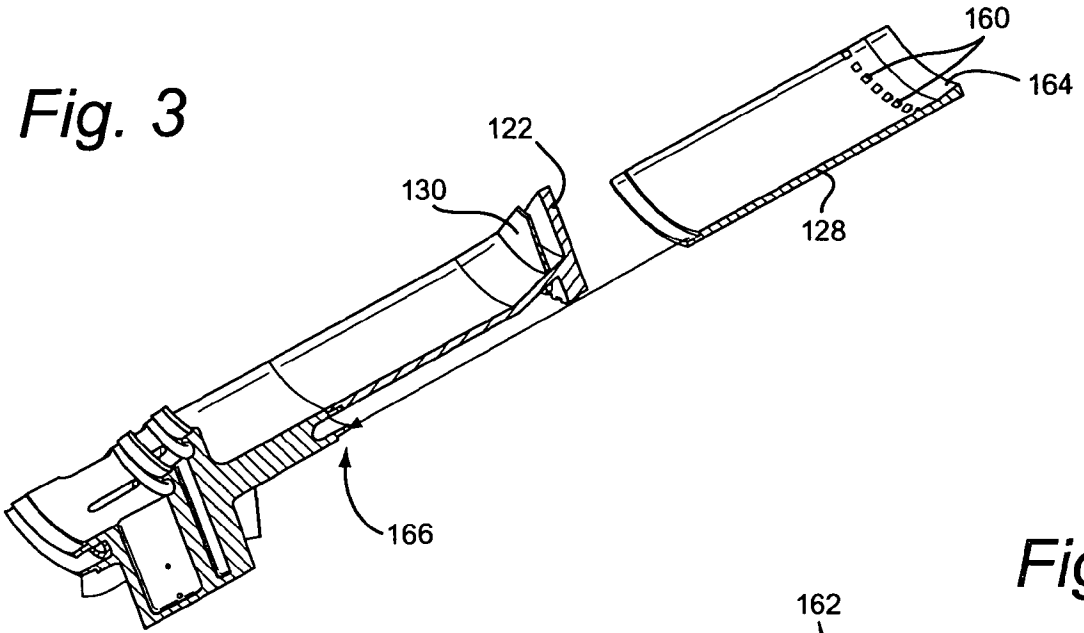
FIG. 3 is an exploded perspective view of a diffusion tip and shroud.
Figure 4:
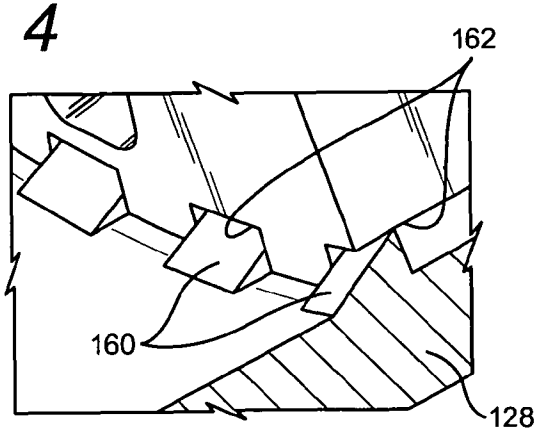
FIG. 4 is an enlarged perspective view illustrating assembly of the distal end of the shroud to the diffusion tip.
Figure 5:
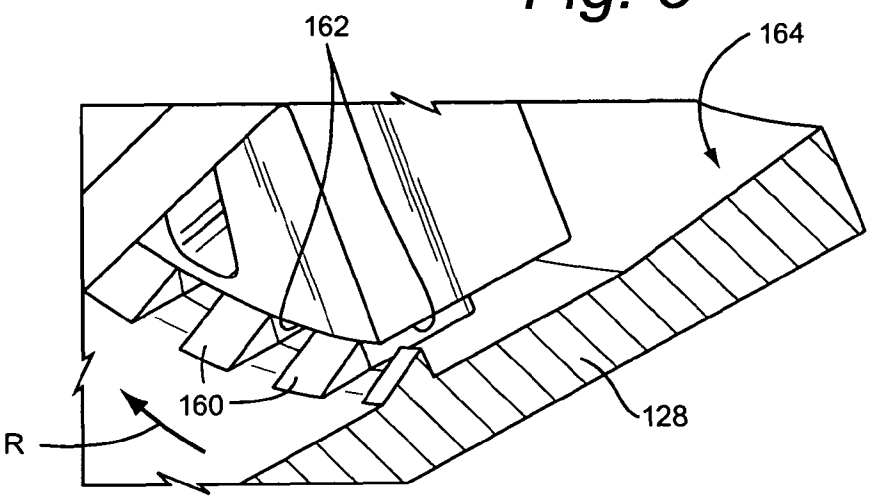
FIG. 5 is an enlarged perspective view illustrating the assembled shroud and diffusion tip assembly.

According to a further feature of the invention, the shroud 128 and tip redundantly retain each other forward and aft. More specifically, FIG. 3 illustrates the shroud exploded away from the remainder of the diffusion tip. According to the retention feature, a plurality of wedges 160 are defined adjacent but spaced from the distal end of the shroud 128. Although a plurality of wedges are included in the illustrated embodiment, manufacturing optimization will likely result in fewer wedges than shown, perhaps 3 to 6 on the full 360 degree part. As illustrated, the periphery of the distal end 122 of the diffusion tip has a plurality of grooves 162 defined therein and the wedges 160 are spaced to slide through the respective groove when the shroud is telescopingly received on the diffusion tip as illustrated in FIG. 4. Once the shroud is fully inserted to engage the nozzle, as illustrated in FIG. 5, the wedges are disposed just forward of the outer periphery of tip end 122. Rotation of the shroud as shown by arrow R then displaces the wedges 160 with respect to the grooves 162 so as to be aligned with the diffusion tip structure to provide forward retention. Meanwhile, in this example embodiment, the distal end of the shroud is wedged as at 164 to provide aft retention. The parts are then brazed at their forward interface 166.

The diffusion tip 110 embodying the invention is not dependent upon particulars of the design of the balance of the fuel nozzle and, thus, may be incorporated in any of a variety of fuel nozzles of the type including a burner tube, a center body assembly concentrically disposed within the burner tube, a premix flow passage defined between the burner tube and the nozzle center body, and a diffusion fuel passage defined within the center body. In an example embodiment, the diffusion tip may be provided in a fuel nozzle of the type illustrated in U.S. Pat. No. 6,438,961, the disclosure of which is incorporated herein by this reference.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle, comprising:

a burner tube component;

a center body assembly concentrically disposed within said burner tube component;

a premix flow passage defined between said burner tube component and said nozzle center body;

a diffusion tip, said diffusion tip comprising a peripheral wall mounted to said center body assembly, an imperforate axial end wall at a distal axial end of said peripheral wall, peripheral orifices defined in said peripheral wall adjacent said axial end wall, and a diffusion tip shroud disposed in surrounding relation to said peripheral wall and mounted to said center body so as to define a cooling air flow passage therebetween, said peripheral orifices being in direct flow communication with axial air passages of said cooling air flow passage surrounding said diffusion tip; and a diffusion fuel passage defined within said center body assembly and terminating distally at an inner surface of said substantially imperforate end wall, wherein said inner surface of said substantially imperforate end wall is turbulated so as to enhance cooling thereof.

2. A fuel nozzle as in claim 1, further comprising a layer of thermal barrier coating disposed on a front, outer surface of said end wall.

3. A fuel nozzle as in claim 1, further comprising a perforated impingement plate disposed in spaced, parallel relation to said inner surface of said imperforate end wall, said impingement plate defining at least one impingement orifice for impingement flow of diffusion fuel or purge air against said inner surface of said imperforate end wall.

4. A fuel nozzle as in claim 3, constructed and arranged so that post impingement flow flows through said peripheral orifices in said peripheral wall.

5. A fuel nozzle as in claim 3, wherein there is a single impingement orifice defined in said impingement plate.

6. A fuel nozzle as in claim 3, wherein said inner surface of said imperforate end wall is turbulated so as to enhance cooling thereof.

7. A fuel nozzle as in claim 3, further comprising a layer of thermal barrier coating disposed on a front, outer surface of said end wall.

8. A diffusion tip for a fuel nozzle, comprising:

a peripheral wall, an imperforate axial end wall at a distal axial end of said peripheral wall, peripheral orifices defined in said peripheral wall adjacent said axial end wall, and a diffusion tip shroud disposed in surrounding relation to said peripheral wall so as to define a cooling air flow passage therebetween, said peripheral orifices being in direct flow communication with axial air passages of said cooling air flow passage surrounding said diffusion tip, wherein said inner surface of said substantially imperforate end wall is turbulated so as to enhance cooling thereof.

9. A diffusion tip for a fuel nozzle as in claim 8, wherein said inner surface of said imperforate end wall is turbulated so as to enhance cooling thereof.

10. A diffusion tip for a fuel nozzle as in claim 8, further comprising a layer of thermal barrier coating disposed on a front, outer surface of said end wall.

11. A diffusion tip for a fuel nozzle as in claim 8, further comprising a perforated impingement plate disposed in spaced, parallel relation to said inner surface of said imperforate end wall, said impingement plate defining at least one impingement orifice for impingement flow of cooling media against said inner surface of said imperforate end wall.

12. A diffusion tip for a fuel nozzle as in claim 11, constructed and arranged so that post impingement flow flows through said peripheral orifices in said peripheral wall.

13. A diffusion tip for a fuel nozzle as in claim 11, wherein there is a single impingement orifice defined in said impingement plate.

14. A diffusion tip for a fuel nozzle as in claim 11, wherein said inner surface of said imperforate end wall is turbulated so as to enhance cooling thereof.

15. A diffusion tip for a fuel nozzle as in claim 11, further comprising a layer of thermal barrier coating disposed on a front, outer surface of said end wall.

16. A diffusion tip for a fuel nozzle, comprising: a peripheral wall, an imperforate axial end wall at a distal axial end of said peripheral wall, peripheral orifices defined in said peripheral wall adjacent said axial end wall, and a diffusion tip shroud disposed in surrounding relation to said peripheral wall so as to define a cooling air flow passage therebetween, said peripheral orifices being in direct flow communication with axial air passages of said cooling air flow passage surrounding said diffusion tip, the diffusion tip further comprising a plurality of wedges protruding from an inner peripheral surface of said shroud, adjacent but spaced from a distal end of the shroud; a plurality of grooves defined in a radially outer periphery of the peripheral wall adjacent said distal axial end thereof, the wedges being sized and spaced to axially slide through a respective groove when the shroud is telescopically received about the peripheral wall of the diffusion tip, and wherein rotation of the shroud after passage of the wedges through the grooves displaces the wedges with respect to the grooves to preclude forward displacement of the shroud with respect to the peripheral wall.

17. A diffusion tip for a fuel nozzle as in claim 16, wherein an inner peripheral wall of the shroud is tapered at said distal end, so that when the wedges have passed fully through the respective grooves, the tapered inner peripheral surface of the shroud engages the distal end of the peripheral wall of the diffusion tip to preclude further aft displacement of the shroud with respect to the peripheral wall of the diffusion tip.

18. A fuel nozzle as in claim 1, wherein the burner tube component includes a distal shroud for being disposed in surrounding relation to said diffusion tip, and further comprising:

a plurality of wedges protruding from an inner peripheral surface of said shroud, adjacent but spaced from a distal end of the shroud;

a plurality of grooves defined in a radially outer periphery of the peripheral wall adjacent said distal axial end thereof, the wedges being sized and spaced to axially slide through a respective groove when the shroud is telescopically received about the peripheral wall of the diffusion tip, and wherein rotation of the shroud after passage of the wedges through the grooves displaces the wedges with respect to the grooves to preclude forward displacement of the shroud with respect to the peripheral wall.

19. A fuel nozzle as in claim 18, wherein an inner peripheral wall of the shroud is tapered at said distal end, so that when the wedges have passed fully through the respective grooves, the tapered inner peripheral surface of the shroud engages the distal end of the peripheral wall of the diffusion tip to preclude further aft displacement of the shroud with respect to the peripheral wall of the diffusion tip.

* * * * *